United States Patent [19]

French

[11] 4,446,797

[45] May 8, 1984

[54] SELF-CONTAINED VAULT UNIT

[76] Inventor: Errol J. French, P.O. Box 1314, Chattanooga, Tenn. 37401

[21] Appl. No.: 260,375

[22] Filed: May 11, 1981

[51] Int. Cl.[3] ..... E05G 1/00

[52] U.S. Cl. ..... 109/53; 109/58; 109/1 R; 52/33

[58] Field of Search ..... 52/33, 34, 128; 434/72–80; 109/53, 58, 1 R, 13, 15, 1 V, 2, 9; 232/5, 6; 43/59; D25/16, 98; D99/28

[56] References Cited

U.S. PATENT DOCUMENTS

| | | | |
|---|---|---|---|
| 617,161 | 1/1899 | Hunter | 52/134 |
| 775,674 | 11/1904 | Given et al. | 109/1 R |
| 1,931,580 | 10/1933 | Johnson | 109/8 |
| 3,964,577 | 6/1976 | Bengtsson | 109/1 R |

*Primary Examiner*—Gene Mancene

*Assistant Examiner*—John G. Weiss

*Attorney, Agent, or Firm*—Pitts, Ruderman & Kesterson

[57] ABSTRACT

A self-contained vault unit which contains a plurality of safety deposit boxes is disclosed. The vault apparatus includes means which define a secure interior chamber in which the safety deposit boxes are positioned. An entrance into the chamber is secured and selectively openable, preferably by security personnel. A plurality of elongated rows of cabinet sections are arranged in a substantially parallel relationship. The cabinet sections define a plurality of openings having preselected cross-sectional outlines which are proportioned for receiving the safety deposit boxes. Each of the boxes includes a lock for securing the box within the cabinet section upon moving the box to its closed position. A plurality of booths are strategically positioned about the vault apparatus for the convenience of customers to inspect the box contents.

12 Claims, 2 Drawing Figures

SELF-CONTAINED VAULT UNIT

TECHNICAL FIELD

This invention relates to a structure for containing safety deposit boxes, and more particularly concerns a self-contained vault unit which secures a plurality of safety deposit boxes. The unit is particularly suitable for being constructed as an independent structure and provides controlled access into the area in which the safety deposit boxes are contained.

BACKGROUND ART

Banks and other lending institutions commonly include a section within the bank vault which contain safety deposit boxes. These boxes are normally rented to customers as an ancillary service. The customer will maintain a key which will open the deposit box independently or in certain cases, in conjunction with a key maintained in the possesion of the bank personnel. Access to the entrance of the area in which the safety deposit boxes are contained within the bank vault is gained through the bank during normal business hours, and therefore access to the contents of the safety deposit box is limited. Moreover, the demand for safety deposit boxes substantially exceeds the supply and often a customer must wait for a year or longer to receive the right to rent a box. This demand for safety deposit boxes is partially due to a desire of people to place certain valuables such as jewelry, silverware, wills or the like at a location which is not exposed to fire or theft.

Accordingly, it is an object of the present invention to provide a self-contained vault unit for containing a plurality of safety deposit boxes. The vault unit is designed to be an independent structure and capable of being operated in a secure manner with minimal manpower. Another object of the present invention is to provide a self-contained vault unit which can be readily constructed in a relatively inexpensive manner and which is energy efficient and operable with low overhead. A further object of the invention is to provide a safety deposit box vault unit which provides convenient, yet restricted access to the deposit box vault chamber which contains the deposit boxes and which provides inspecting booths at preselected and convenient locations for the customers. Still, a further object of the invention is to provide a self-contained vault unit which efficiently utilizes the space available within the vault chamber while providing ready access and free mobility to authorized customers.

DISCLOSURE OF THE INVENTION

In accordance with various features of the present invention, a self-contained vault unit is provided which contains a plurality of safety deposit boxes. The unit includes means defining a secure interior chamber in which the safety deposit boxes are contained. A selectively operable entrance is provided into the chamber containing the safety deposit boxes and in one embodiment, entrance is gained into the chamber through an entrance security room in which a security check is made prior to admitting a person into the safety deposit box area. A plurality of elongated rows of cabinet sections are arranged in a substantially parallel relationship and define aisles therebetween. The cabinet sections define a plurality of openings, each of which have a preselected cross-sectional outline and which are proportioned for receiving the safety deposit boxes which are inserted as by sliding, into the cabinet section openings. Each of the boxes includes a lock for securing the box within the cabinet section upon moving the box to its closed position. A plurality of booths are strategically placed within the vault to facilitate customer inspection of the contents of their deposit boxes.

BRIEF DESCRIPTION OF THE DRAWINGS

Various other objects and advantages of the present invention will become readily apparent upon reading the following detailed description together with the drawings in which.

BEST MODE FOR CARRYING OUT THE INVENTION

Figure 1:
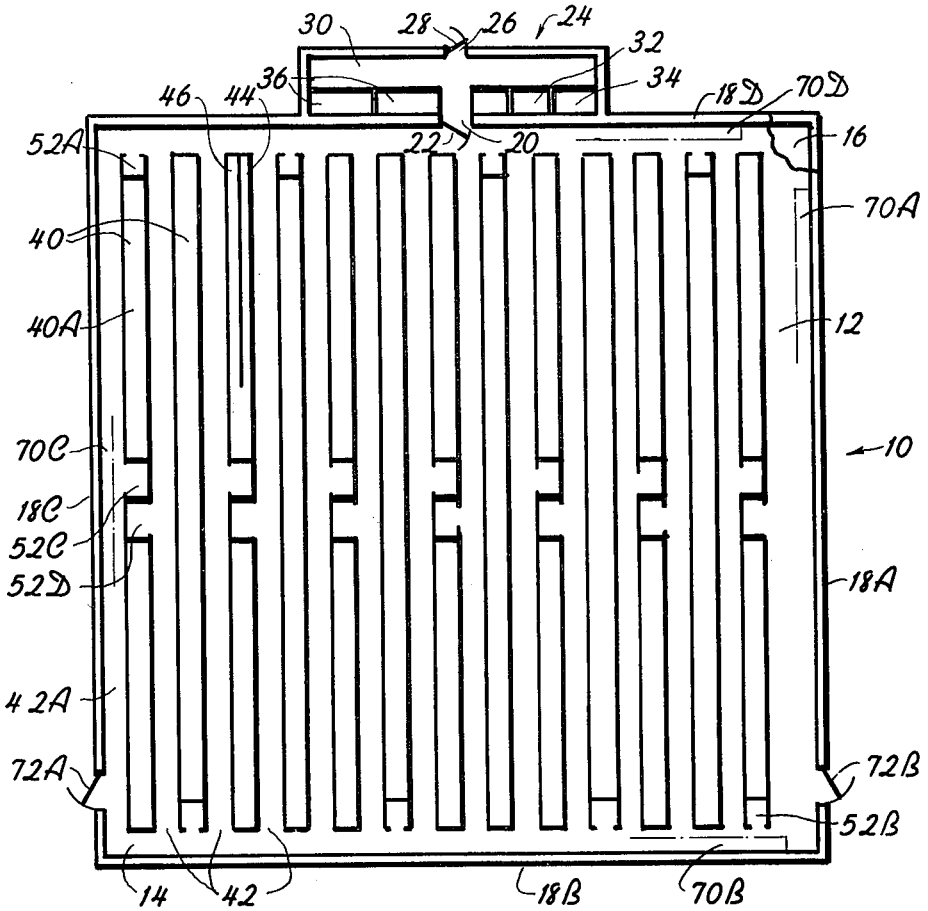
FIG. 1 is a plan view of a self-contained vault unit constructed in accordance with various features of the present invention.

Referring now to the figures, a self-contained vault unit constructed in accordance with various features of the invention is illustrated generally at 10 in FIG. 1. This vault unit is particularly suitable for being constructed as an independent structure and is designed to provide limited access by authorized customers into the chamber in which the safety deposit boxes are obtained. In this connection, the vault unit defines a secure interior chamber generally indicated at 12. This chamber 12 is defined by the floor 14, the roof 16, and the upright walls 18. Preferably, the walls 18 A–D are fabricated from an insulated material and can be reinforced for purposes of security. In one embodiment of the invention, the walls 18 include a singular entrance and will not be provided with external windows which will enhance the building security and the insulating effect of the structure. Also, the ceiling portion (not shown) of the structure will be insulated such that the chamber 12 can be maintained at a comfortable and preselected temperature with minimal energy expenditures.

Entry is gained into the chamber 12 in the illustrated embodiment through an entrance 20 which comprises a conventional doorway through the wall 18D. This entrance 20 is selectively opened and closed by the door 22, and this door is preferably operated by security personnel who will remain within the structure at all times to assure limited access into the chamber area 12.

In the embodiment illustrated in FIG. 1, an entrance security room generally indicated at 24 is provided through which customers must pass in order to enter the chamber 12 through the entrance 20. This entrance security room includes a front entrance 26 having a door 28 selectively opened and closed by security personnel or the customer. Security personnel will normally remain stationed within the area generally indicated at 30 in the entrance security room and check the authority of persons to enter into the safety deposit chamber. In this connection, each customer will preferably be issued an identification card having the customer's picture thereon to assist the security personnel in admitting only authorized persons. The entrance security room 24 also includes restroom facilities indicated at 32 and 34 for men and women, respectively. A utility area and a teller office are provided at 36 within the entrance security room for the convenience of the building personnel.

A plurality of elongated rows of cabinet sections generally indicated at 40 are positioned within the chamber 12 in a substantially parallel relationship. These rows of cabinet sections define aisles generally indicated at 42 therebetween which are proportioned to provide ready mobility of customers within the chamber and between the cabinet section rows. Each of the cabinet sections is substantially upright and define opposite sides 44 and 46 which face opposite aisles. These sides 44 and 46 of the cabinet sections each define spaced columns of opening 48 (see FIG. 2) having preselected cross-sectional outlines and which are arranged in a grid pattern on each of the sides of the cabinet sections. These openings serve to receive the safety deposit boxes 50 which slidably move into and out of the openings 48. Preferably, the safety deposit boxes are of conventional design and include a lock operable by a key which is maintained in the possession of the renter which is used in conjunction with a waster key held by one of the security personnel such as the teller. The lock serves to secure the box within the respective cabinet section upon moving the box to its closed position.

Figure 2:
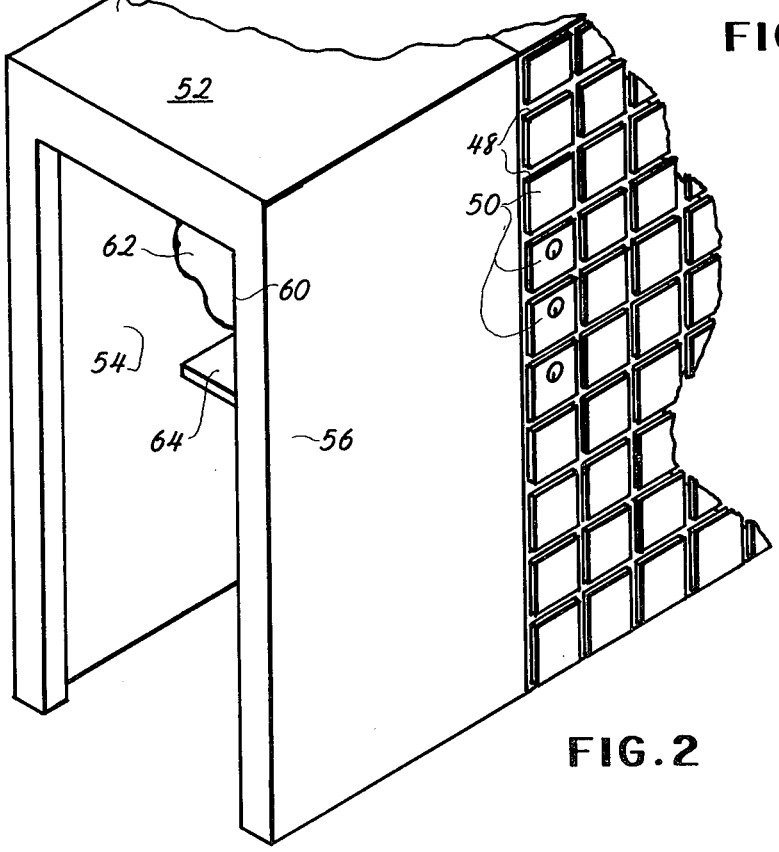
FIG. 2 is a perspective view of a portion of one of the cabinet sections illustrating the safety deposit boxes inserted in the cabinet section openings and further illustrates an exemplary booth.

These boxes are selectively removable from the openings 48 such that the customer can carry the boxes to designated locations for inspecting the box contents. To this end, a plurality of booths generally indicated at 52 are provided which serve to give the customer privacy while inspecting the contents of his safety deposit box. An exemplary booth is illustrated in FIG. 2, which is positioned on the ends of the rows of cabinet sections includes a pair of side walls 54 and 56, respectively which are joined at their rearward edges with the end portion of the adjacent cabinet sections which serve to close the rearward portion of the booth. The upper portion of the booth is closed by an upper wall 58 and entry is gained into the confines of the booth through the opening 60 which in certain embodiments includes a cover or door 62 to provide the customer privacy during box inspection. Preferably, there will be a lock on the booth door which is operable from the inside, and from the outside by security personnel in the event of an emergency. A support or table member 64 is provided in each of the booths to support the box contents during inspection. As illustrated in FIG. 1, the booths are strategically positioned within the chamber containing the safety deposit boxes for the convenience of the customers and to assist in preventing the customer from having to walk substantial distances within the chamber to find a booth location. In this connection, each of the end cabinet sections, that is the cabinet section proximate wall 18C and the cabinet section proximate the wall 18A, include end booths 52A and 52B, respectively. Moreover, midway between the end portions of these cabinet sections, further booths constructed in a manner similar to booth 52 are provided which open into aisles on the opposite sides of the cabinet sections. More specifically, in the row 40A which includes the booth 52A and which is positioned proximate the wall 18C, a booth 52C is provided which opens into the aisle 42A between the wall 18C and the cabinet section 40A. Similarly, a further booth 52D is provided which opens into the aisle between the cabinet section 40A and the adjacent cabinet section. For the convenience of the customers, this centrally positioned pair of booths is staggered, that is integrated into every other row of cabinet sections along the length of the chamber. The intermediate rows of cabinet sections, between the rows of cabinet sections containing centrally positioned booths, contain at least one booth on at least one end portion as illustrated. More particularly, every other cabinet section terminates in at least one booth or one of its end portions for the convenience of the customers as provided.

In one embodiment, an emergency exit is provided which is operable from the chamber by customers or personnel desiring to exit the unit as during a fire. Examples of such exits located proximate the rearward portion of the building are shown at 72 A–B in FIG. 1.

It will be recognized that the self-contained safety desposit box vault unit of the present invention can incorporate various dimensions. However, the inventor has designed a safety deposit box vault having dimensions which are suitable in certain applications. More specifically, the outside dimension along the wall 18B is 152 feet in one embodiment and the outside dimension along wall 18C is 172 feet. The entrance doorway 20 is 6 feet and each of the cabinet sections contains double rows of boxes as illustrated at 44 and 46 in FIG. 1. Each of the boxes are 10 inches high, 10 inches deep and 24 inches long such that the total width dimension of the cabinet is 48 inches. Cabinet sections are provided to accommodate up to 50,000 boxes or more. To this end, in one embodiment the walls 18 A–D incorporate cabinet sections 70 A–D which also include boxes which will enhance the efficiency with which the available wall space is utilized. As necessary or desired, a step ladder can be used by security personnel only to reach the upper boxes. Each of the sides of the section will contain ten levels or rows of boxes as illustrated in FIG. 2.

From the foregoing detailed description, it will be recognized that a self-contained unit has been described and illustrated which has certain advantages over known prior art safety deposit box vaults incorporated in banking institutions. More specifically, the vault unit of the present invention is designed for energy efficiency and for efficient utilization of the enclosed space. Access into the chamber within which the safety deposit boxes are contained is restricted by positioning an entrance security room proximate the entrance through which a person must pass in order to enter the chamber in which the safety deposit boxes are positioned. The chamber contains a plurality of cabinet sections, each of which includes opposite sides containing rows and columns of safety deposit boxes disposed in a grid-like manner in a vertical plane defined by the opposite sides of the cabinet sections. The booths are stragetically positioned with the chamber to facilitate customer access for purposes of inspection and privacy.

While a preferred embodiment has been shown and described, it will be understood that there is no intent to limit the invention by such disclosure, but rather, it is intended to cover all modifications and alternate constructions falling within the spirit and scope of the invention as defined in the appended claims.

I claim:

1. A self-contained vault unit for containing a plurality of safety deposit boxes, said vault unit comprising:

means defining a secure interior chamber wherein said safety deposit boxes are contained, a selectively operable security-controlled entrance into said chamber, a plurality of elongated rows of cabinet sections arranged in a substantially parallel relationship and defining aisles therebetween, said cabinet sections provided with a plurality of openings having a preselected cross-sectional outline, a plurality of safety deposit boxes for inserting into said openings in said cabinet sections, each of said boxes including releasable lock means toward said aisles for securing said box within said cabinet sections upon moving said box to its closed position, said boxes being selectively removable from said cabinet openings upon release of said lock means, and a plurality of inspection booths incorporated in said rows of cabinets sections of said boxes, each of said booths including a table for positioning a safety deposit box thereon during the inspection of contents of said safety deposit box.

2. The self-contained vault unit of claim 1 wherein said means defining a secure interior chamber includes wall means, floor means and roof means, said wall means being reinforced to assist in preventing burglary, and wherein said rows of cabinet sections define perimeter aisles with respect to said wall means.

3. The self-contained vault unit of claim 1 including an entrance security room including a security controlled entrance which is selectively operable and which opens into said entrance of said chamber whereby a person entering said vault unit must pass through said entrance security room.

4. The self-contained vault unit of claim 3 wherein said entrance security room includes a booth for inspecting said contents of said safety deposit boxes.

5. The self-contained vault unit of claim 1 wherein said rows of cabinet sections include opposite sides along their length, each of said sides defining a plurality of openings for receiving said safety deposit boxes.

6. The self-contained vault unit of claim 5 wherein said openings for receiving said boxes are arranged in columns on the opposite sides of said cabinet sections.

7. The self-contained vault unit of claim 5 wherein each of said rows of cabinet sections includes at least one booth for inspecting the contents of said boxes.

8. The self-contained vault unit of claim 5 wherein every other one of said cabinet sections includes a pair of booths facing opposite directions and which are accessible from the adjacent aisles extending along the length of the cabinet section.

9. A self-contained vault unit for containing a plurality of safety deposit boxes, said vault unit comprising:

means defining a secure interior chamber wherein said safety deposit boxes are contained, said means including wall means, floor means, and roof means, said wall means being reinforced to assist in preventing burglary, a selectively operable security controlled entrance into said chamber, an entrance security room, including a further security controlled entrance which is selectively operable from the outside, which opens into said entrance of said chamber whereby a person entering said vault unit must pass through said entrance security room, a plurality of elongated rows of cabinet sections arranged within said chamber in a substantially parallel relationship and defining aisles therebetween and perimeter aisles with respect to said wall means, said cabinet sections defining a plurality of openings having a preselected cross-sectional outline, each of said cabinet sections including opposite sides along their length, a plurality of safety deposit boxes for inserting into said openings in said cabinet sections, each of said boxes including releasable lock means toward said aisles for releasibly securing said box within said cabinet sections upon moving said box to its closed position, said boxes being selectively movable from said cabinet openings upon release of said lock means, and a plurality of inspection booths for inspecting the contents of said boxes, each of said booths including a table for positioning a box thereon during the inspection of said safety deposit box contents, and wherein every other row of said cabinet sections terminates at one of its end portions in a booth, and wherein every other row of said cabinet sections includes a pair of booths proximate its midportion which opens in opposite directions into said aisles on the opposite sides of said cabinet sections.

10. The self-contained vault unit of claim 9 wherein said entrance security room includes a booth for inspecting the contents of said boxes and further includes a security guard office for the convenience of security personnel.

11. The self-contained vault unit of claim 10 wherein cabinet sections are mounted on said wall means and define a plurality of openings which receive said safety deposit boxes.

12. The self-contained vault unit of claim 9 including at least one emergency exit in said wall means selectively operable from the inside of said security chamber.

* * * * *